US005398935A

United States Patent [19]

Katayama

[11] Patent Number: 5,398,935

[45] **Date of Patent: * Mar. 21, 1995**

[54] GOLF WOOD CLUBHEAD

[75] Inventor: Yutaka Katayama, Tokyo, Japan

[73] Assignee: Maruman Golf Kabushiki Kaisha, Tokyo, Japan

[ * ] Notice: The portion of the term of this patent subsequent to Feb. 22, 2011 has been disclaimed.

[21] Appl. No.: 120,856

[22] Filed: Sep. 15, 1993

Related U.S. Application Data

[63] Continuation of Ser. No. 798,729, Nov. 27, 1991, abandoned.

[30] Foreign Application Priority Data

Nov. 29, 1990 [JP] Japan ..... 2-325552

[51] Int. Cl.[6] ..... A63B 53/04

[52] U.S. Cl. ..... 273/167 A; 273/167 E; 273/167 J

[58] Field of Search ..... 273/167 R–77 A, 273/79, 77 R, 193 R, 194 R, 164.1, 186.2, 187.4

[56] References Cited

U.S. PATENT DOCUMENTS

| | | | |
|---|---|---|---|
| 1,096,359 | 5/1914 | Dwight | 273/169 |
| 1,396,470 | 11/1921 | Taylor | 273/77 R |
| 1,528,017 | 3/1925 | Gammeter | 273/167 E |
| 1,555,425 | 9/1925 | McKenzie | 273/167 E |
| 1,587,758 | 6/1926 | Charavay | 273/167 E |
| 1,617,090 | 2/1927 | Worthington | 273/169 X |
| 1,638,916 | 8/1927 | Butchart | 273/169 |
| 2,169,774 | 8/1939 | Taylor | 273/72 R |
| 2,705,147 | 3/1955 | Winter | 273/167 R X |
| 3,250,536 | 5/1966 | Moser | 273/169 X |
| 3,743,297 | 7/1973 | Dennis | 273/171 X |
| 3,845,955 | 11/1974 | Solheim | 273/167 A X |
| 4,247,105 | 1/1981 | Jeghers | 273/77 A |
| 4,828,265 | 5/1989 | Antonious . | |
| 4,896,885 | 1/1990 | Kajita et al. | 273/167 H |
| 5,092,599 | 3/1992 | Okumoto | 273/167 E |

FOREIGN PATENT DOCUMENTS

| | | | |
|---|---|---|---|
| 904785 | 8/1962 | United Kingdom . | |
| 1063798 | 3/1967 | United Kingdom | 273/167 A |

*Primary Examiner*—Sebastiano Passaniti

*Attorney, Agent, or Firm*—Armstrong, Westerman, Hattori, McLeland & Naughton

[57] ABSTRACT

A golf wood clubhead has a head body having heel and toe portions and face and sole portions which extend between the heel and toe portions, respectively, and define a leading edge at the intersection thereof. The height of the face portion at the side close to the toe portion is nearly equal to or greater than that of the same at the center thereof.

5 Claims, 4 Drawing Sheets

GOLF WOOD CLUBHEAD

This application is a continuation of application Ser. No. 07/798,729, filed Nov. 27, 1991, now abandoned.

BACKGROUND OF THE INVENTION

1. Field of the Invention

The present invention relates generally to a golf wood clubhead. It is to be understood that the term "wood clubhead" as used in the following description and the attached claims is not limited to those made of wood but also includes those made of other materials such as synthetic resin, metal or the like. More particularly, the invention relates to a golf wood clubhead having a head body which has a specific outer shape concerning the height thereof.

2. Description of Related Art

Generally, conventional golf wood clubheads comprise a head body having toe and heel portions and face and sole portions which extend between the toe and heel portions, respectively, and which define a leading edge at the intersection thereof. In these conventional wood clubhead, the height $h_o$ of the face portion at the center thereof is greater than the height $h_t$ of the same at the side of the toe portion, as shown in FIG. 2, in order to create a sweet spot portion in about the center thereof.

However, the art of obtaining a square hit at the sweet spot portion, i.e., the center portion of the face, is difficult with beginners, and although they have strongly desired easy wood clubheads to swing, their desire has not been fulfilled satisfactorily.

Moreover, there have been many different requests for improvement of conventional wood clubs, some calling for a head speed sufficient to provide a desired distance of flight and some calling for a good return of the head to enable an undisturbed follow-swing but these demands have not been met to the full extent as yet.

The present inventor has made the intensive studies with improvement of the wood clubhead construction with a view to dissipating the defects of conventional wood clubheads and providing the better performance characteristics. As the result, the inventor has found that a wood club easy to swing and excellent at other different effects, can be obtained by designating the face thereof in such a manner that the height $H_t$ of the face portion at the side close to the toe portion is greater than the height of the same at the center $H_o$ thereof. The present invention has been completed on the basis of this finding.

SUMMARY OF THE INVENTION

It is therefore an object of the present invention to provide a golf wood clubhead which makes it possible to easily execute a stable club swing.

Another object of the invention is to provide a golf wood clubhead which makes it possible to increase the head speed during the swing, while making it easy to execute a smooth follow-swing.

According to the present invention, the above-mentioned objects can be achieved by a golf wood clubhead comprising a head body having toe and heel portions and face and sole portions which extend between the heel and toe portions, respectively, and define a leading edge at the intersection thereof, wherein the height of the face portion at the side close to the toe portion is nearly equal to or greater than that of the same at the center thereof.

With the above-mentioned construction, the clubhead of the present invention has a large effective hit area in the face, as compared with the conventional clubheads, successfully serving golf players to dissipate the lack of confidence at an address position. Further, according to the above-mentioned construction, since the center of gravity of the head body is located close to the toe portion, the head speed when the club is swung can be increased and the toe weight allows the clubhead to make a good rotation during the follow-swing after the impact.

Preferably, the width from the leading edge of the head body to the rear end of the sole is nearly equal to or less than a half of the width from the leading edge of the head body to the rear end thereof. According to this construction, it is possible to provide a golf wood club capable of easy swings, wherein the area of the sole portion is reduced while minimizing the increase of the head weight and the sole portion is susceptible to much less contact resistance by the ground or turf.

Also because of less contact resistance, the clubhead can hit the ball without reducing the head speed and without disturbing the swing orbit immediately after the impact.

Duffing is a phenomenon that the sole surface comes into contact with the ground before the head meets the ball, disturbing the direction and speed of the head. In the case that the area of the sole portion is reduced, it is possible to decrease the possibility of contact of the sole portion with the ground, thus minimizing the possibility of generation of duffing.

Preferably, the head body has a rounded lower back portion of a certain radius of curvature within a region from the rear end of the sole portion to the rear end of the head body. According to this construction, contact resistance between the head body and the ground or turf as well as the possibility of generation of duffing can be reduced more greatly.

In the case that the head body has the above-mentioned rounded lower back portion, the sole portion may have a rounded surface of the same radius of curvature as that of the rounded lower back portion within a region from the leading edge of the head body to the rear end of the sole portion. Preferably, the rounded sole and the rounded lower back portion together constitute a common rounded surface. According to this construction, contact resistance between the surface of the head body and the ground or turf as well as the possibility of duffing can be decreased more greatly.

Alternatively, in the case that the head body has the above-mentioned rounded lower back portion, the sole portion may have a generally flat surface which continuously connected at the rear end thereof with the rounded lower back portion. In this case, preferably, the leading edge of the head body has a curved shape.

Preferably, the head body has a generally flat top portion extending from the upper edge of the face portion to the rear end of the head body. According to this construction, air resistance on the surface of the top portion can be reduced during the swing, and therefore it is possible to increase the head speed and maintain the stability of orientation of the clubhead. Accordingly, the clubhead can be very readily swung even if it is used by beginners.

Further, the overall head body may have a rearward projecting shape. In this case, preferably, the overall width between the leading edge of the head body and the rear end thereof is made greater than that between the heel and toe ends of the head body. According to these construction, the depth of the center of gravity of the clubhead from the face portion can be increased. Accordingly, the loft angle of the clubhead can be increased at the time of the impact, thus permitting ready flying of the ball.

These and other objects, features and advantages of the present invention will become apparent from the following detailed description of the preferred embodiments with reference to the drawings.

DETAILED DESCRIPTION OF THE PREFERRED EMBODIMENTS

Figure 1:
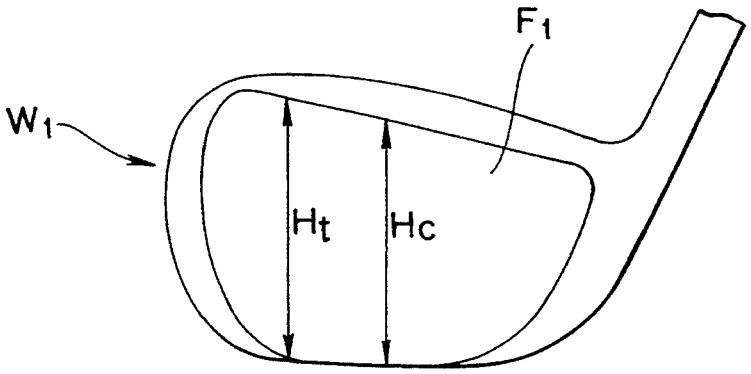
FIG. 1 is a side view of a golf wood clubhead showing a first embodiment of the present invention, viewed from the side of the face portion.
Figure 2:
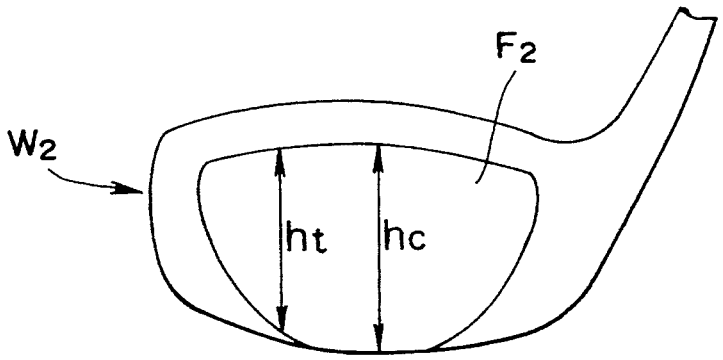
FIG. 2 is a view similar to FIG. 2 but showing a conventional golf wood clubhead.

FIG. 1 is a side view of a golf wood clubhead showing a first embodiment of the present invention, while FIG. 2 show a corresponding view of a conventional golf wood clubhead. Referring to FIG. 1, the clubhead of the first embodiment comprises a head body $W_1$ having heel and toe portions and face and sole portions which extend between the heel and toe portions, respectively, and define a leading edge at the intersection thereof. In FIG. 1, $F_1$ denotes the face portion of the head body $W_1$. It is the most important feature of the clubhead that the height $H_t$ of the face portion $F_1$ at the side close to the toe portion is nearly equal to or greater than the height $H_o$ of the same at the center thereof. Such relationship between the two heights forms a remarkable contrast to that of the conventional wood head body $W_2$ shown in FIG. 2, wherein the height $h_t$ of the face portion $F_2$ at the side close to the toe portion is smaller than the height $h_o$ of the same at the center thereof.

In the first embodiment, the face portion defined in above-mentioned way is a large surface, thus providing a large effective hit area.

In the clubhead of the first embodiment, since the center of gravity $G_1$ of the head body $W_1$ is shifted away from the center of the face toward the toe portion as compared with the conventional head body $W_2$, the head speed can be increased due to the increase of centrifugal force when the club is swung, and with the player's wrist uncocked or re-cocked, the head can be readily rotated by virtue of the toe weight during the follow-swing after the impact. Accordingly, it is possible to execute the follow-swing smoothly.

Further, in the first embodiment, since the center of gravity $G_1$ is shifted away from the center of the head body $W_1$ toward the toe portion, the sweet spot in the face portion $F_1$ is also shifted away from the center of the face portion toward the toe portion.

Furthermore, in the first embodiment, since the larger effective hit area is provided, golfers can easily loft the ball without fail even if the hit point is off the sweet spot to some extent.

Particularly, it is apparent that the large hit area is very effective to enable golfers to overcome the lack of confidence at an address position. Furthermore, the other effect to be produced by the location of the center of gravity will be described later, referring to FIG. 10.

Figure 3:
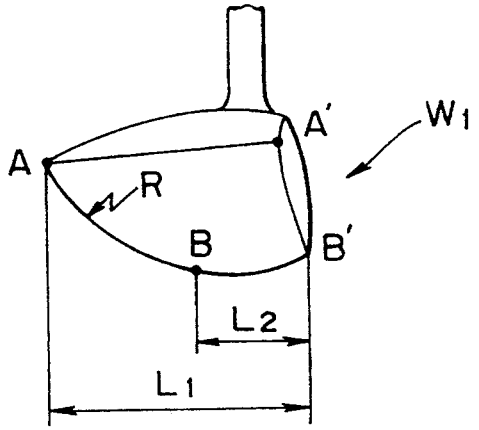
FIG. 3 is a perspective view of a golf wood clubhead showing a second embodiment of the present invention, viewed from the side of toe portion.
Figure 4:
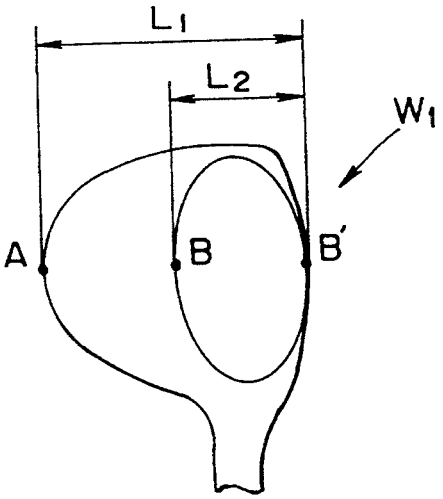
FIG. 4 is a plan view of the clubhead shown in FIG. 3, viewed from the side of the sole portion.

FIGS. 3 and 4 show a second embodiment of the present invention in which the height distribution of the face portion is the same as that of the first embodiment. In the second embodiment, the overall width $L_1$ of the head body $W_1$, i.e., the width from the leading edge B' of the head body to the rear end A thereof, and the width $L_2$ of the sole portion thereof, i.e., the length from the leading edge B' to the rear end B of the sole portion are characterized by the following relation.

$$L_2 \leqq \tfrac{1}{2} \times L_1$$

Figure 5:
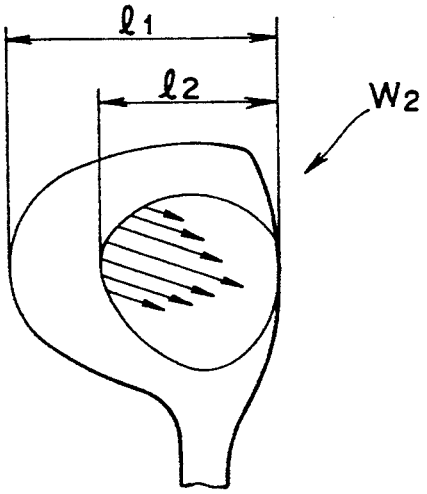
FIG. 5 (Prior Art)
FIG. 5 is a view similar to FIG. 4 but showing a conventional golf wood clubhead.

FIG. 5 shows a conventional golf wood clubhead. In the conventional clubhead, the overall width $l_1$ of the clubhead $W_1$ and the width $l_2$ of the sole portion, corresponding to those of the second embodiment, are related as $l_2 < l_1$, but the difference between the two widths is small, i.e., $l_2 > \frac{1}{2} \times l_1$. Therefore, when the swing is executed with the conventional clubhead, the sole portion receives a great contact resistance from the ground or turf, as shown by the arrows in FIG. 5. This may cause a great reduction of the head speed or a great deviation of the clubhead from the swing orbit. Further, in the case that the golfer's swing is not so stable, the so called "duffing" may often occur when hitting a ball, i.e., the clubhead may strike the ground just before the ball. At this time, the sole portion receives a great reaction force from the ground because of its large area, thus causing the clubhead to be bounded from the ground and resulting in an inaccurate hit.

With the provision of the above-mentioned specific relation between the head overall width $L_1$ and sole width $L_2$ of the head body $W_1$, the above drawbacks can be eliminated. That is, the contact resistance offered to the sole portion can be greatly reduced by virtue of the decreased area of the sole portion, and thus the clubhead according to the invention can be stably and smoothly swung.

Referring again to FIGS. 3 and 4, the clubhead has a rounded lower back portion of radius R extending from the rear end B of the sole portion to the rear end A of the head body $W_1$, thus making it easy to execute a stable swing. The radius R of the rounded lower back portion between the points B and A may be nearly equal to or less tan 250 mm, but it is not limited thereto.

In the embodiment shown in FIGS. 3 and 4, the sole portion has a rounded surface of the same radius as that of the rounded lower back portion and is continuously connected at the rear end portion to the rounded lower back portion. This means that the sole portion and the lower back portion of the head body $W_1$ together creates a single rounded shape of radius R between the points B' and A. In this case, contact resistance between the sole portion and the ground or turf can be more greatly decreased by virtue of the integrated rounded shape including the sole portion and the lower back portion. Accordingly, it is possible to reduce more greatly the contact resistance offered to the lower surface of the head body from the ground or turf and thereby to increase the head speed during the forward swing.

Alternatively, the sole portion extending between the points B and B' of the head body $W_1$ may have a generally flat surface. In this case, preferably, only a leading edge B' of the head body $W_1$ is formed as a rounded edge.

In the second embodiment, the sole width $L_2$ may be varied within the range in which the above-mentioned relationship between the length $L_1$ and $L_2$ is ensured, but it should be such that the stability of the clubhead can be ensured when the clubhead is addressed.

Figure 6:
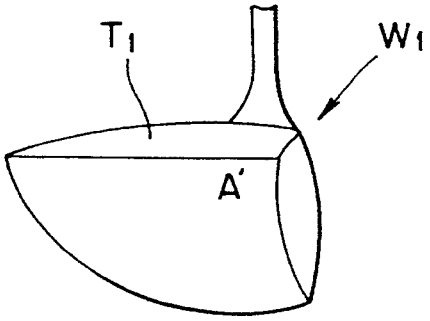
FIG. 6 is a perspective view of a golf wood clubhead showing a third embodiment of the present invention, viewed from the side of the toe portion.

FIG. 6 shows a third embodiment of the present invention, in which the height distribution of the face portion is the same as that of the first embodiment, while the relationship between the sole width and the overall width of the head body $W_1$ is the same as that of the second embodiment.

Figure 7:
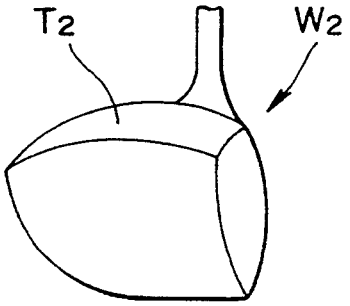
FIG. 7 (Prior Art)
FIG. 7 is a view similar to FIG. 6 but showing a conventional clubhead.

The head body $W_1$ shown in FIG. 6 is further characterized by the top portion $T_1$ thereof which has a generally flat surface between the upper edge of the face portion and the rear end of the head body. This means that if the clubhead of the second embodiment is designed such that the height of the head body, i.e., the height from the sole portion to the top portion $T_1$ is substantially the same as that of a conventional clubhead $W_1$ as shown in FIG. 7, it is possible to design the rear end portion of the head body $W_1$ so that the rear end portion projects rearward or sidewards more greatly in comparison to that of the conventional clubhead under the condition of the same clubhead volume, as apparent from FIGS. 6 and 7.

According to the construction of the third embodiment, it is possible to increase the area of the top portion $T_1$ of the head body $W_1$ in comparison to that of the conventional clubhead having a rounded top portion. In this case, the head body $W_1$ of the clubhead according to the third embodiment of the invention can be seemed to have a large volume than that of the conventional clubhead having the same volume as that of the second embodiment when the clubhead is addressed, thus causing the player to feel safe.

In addition, the depth of the center of gravity of the clubhead, i.e., the distance from the face portion to the center of gravity, is increased due to the partial transfer of mass of the head body from the top portion thereof into the rear end portion thereof. Such construction is effective to fly up the golf ball more readily, as will be described later in more detail.

Further, since the top portion $T_1$ of the third embodiment has a generally flat surface up to the rear end of the head body $W_1$, it is possible to generate air boundary separation at a region rearward from the head body $W_1$, thus resulting in the reduction of air resistance and increase of the head speed.

Figure 8:
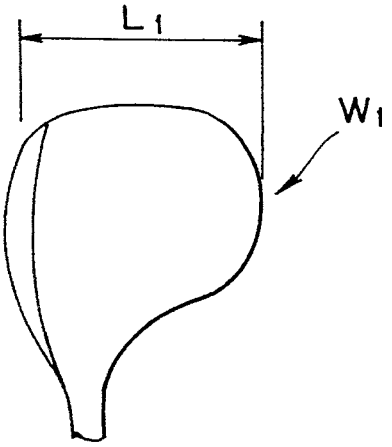
FIG. 8 is a perspective view of a golf wood clubhead showing a fourth embodiment of the present invention, viewed from side of the top portion.

FIG. 8 shows a fourth embodiment of the present invention, in which the height distribution of the face portion is the same as that of the first embodiment, while the relationship between the sole width and the overall width of the head body $W_1$ is the same as that of the second embodiment.

Figure 9:
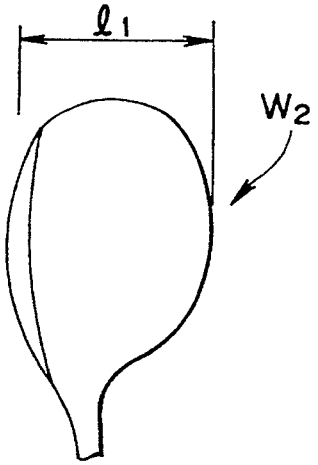
FIG. 9 (Prior Art)
FIG. 9 is a view similar to FIG. 6 but showing a conventional clubhead.

In the structure shown in FIG. 8, a feature resides in that the head body $W_1$ looked from the top has a peripheral configuration projecting rearward in comparison to that of a conventional head body $W_2$ shown in FIG. 9. According to the structure of the fourth embodiment, it is possible to increase the depth of the center of gravity of the head body $W_1$, i.e., the depth from the face portion thereof to the center of gravity, in comparison to that of the conventional head body $W_1$.

Figure 10:
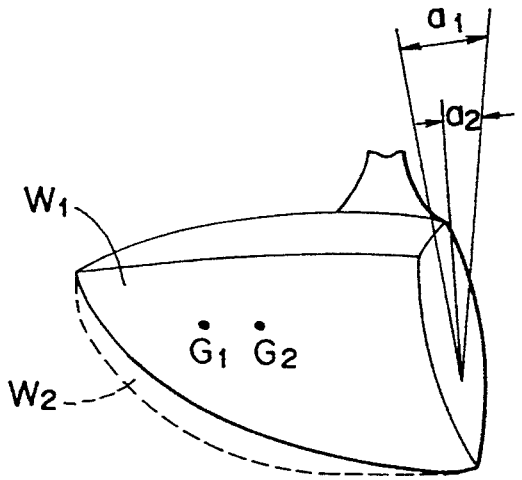
FIG. 10 shows a comparison between the conventional clubhead (dotted line) and that of the fourth embodiment of the present invention (solid line) with reference to the location of the center of gravity and the angle of loft at the time of impact.

FIG. 10 is a view for explaining a positional relationship of the center of gravity of the clubheads $W_1$ and $W_2$, in which the solid line represents the outer shape of the head body $W_1$ according to the invention, while the dotted line represents the outer shape of the conventional head body $W_2$.

With this positional relationship concerning the center of gravity, the head body $W_1$ according to the invention, in which the center of gravity $G_1$ exists more rearward from the center of gravity $G_2$ of the conventional head body $W_2$, can be rotated more readily in the counterclockwise direction in FIG. 10 while striking the ball. Thus, at the time of the impact the loft angle $a_1$ of the head body $W_1$ according to the invention is made larger than the loft angle $a_2$ of the conventional head body $W_2$ due to rotation of the head body, and thus the ball is more readily lofted up.

In the embodiments shown in FIGS. 6 and 8 having a rearward projecting shape, a dimensional relationship between the length from the heel to the toe of the head body $W_1$ and the width from the face portion to the rear end thereof may be such that the latter is nearly equal to or less than the former.

While the invention has been described in conjunction with specific embodiments thereof, it is evident that many alternatives and modifications will be apparent to those skilled in the art in light of the foregoing description. Accordingly, it is intended to include all such alternatives and modifications as fall within the spirit and scope of the appended claims.

What is claimed is:

1. A golf wood clubhead, comprising:

a head body having a heel portion, a toe portion, and a face portion and a sole portion which extend between said heel portion and said toe portion, respectively, said face portion and said sole portion intersecting at a leading edge;

wherein said sole portion of said head body is convex downwardly, a height of said face portion at a side close to said toe portion being nearly equal to or greater than that of a height at a center portion of said face portion, a width from said leading edge of said head body to a rear end of said sole portion being nearly equal to or less than a half of a width from said leading edge of said head body to a rear end of said head body, said head body having a nearly flat top portion extending from an upper edge of said face portion of said head body to said rear end of said head body, wherein said top portion is formed so as to extend substantially in parallel to the ground when the clubhead is brought into address on the ground, and wherein a width from said leading edge of said head body to said rear end of said head body is nearly equal to or less than a length between said heel portion and said toe portion of said head body.

2. The golf wood clubhead according to claim 1, wherein said head body has a rounded lower back portion of a certain radius of curvature within a region from said rear end of said sole portion to said rear end of said head body.

3. The golf wood clubhead according to claim 2, wherein said sole portion is formed as a rounded surface of a radius of curvature which is the same as that of said rounded lower back portion which is continuously connected at said rear end of said sole portion with said rounded lower back portion.

4. A golf wood clubhead, comprising:

a head body having a heel portion, a toe portion, and a face portion and a sole portion which extend between said heel portion and said toe portion, respectively, said face portion and said sole portion intersecting at a leading edge;

wherein a height of said face portion at a side close to said toe portion is nearly equal to or greater than that of a height at a center portion of said face portion, a width from said leading edge of said head body to a rear end of said sole portion being nearly equal to or less than a half of a width from said leading edge of said head body to a rear end of said head body, said head body having a nearly flat top portion extending from an upper edge of said face portion of said head body to said rear end of said head body, wherein said top portion is formed so as to extend substantially in parallel to the ground when the clubhead is brought into address on the ground, and wherein a width from said leading edge of said head body to said rear end of said head body is nearly equal to or less than a length between said heel portion and said toe portion of said head body;

wherein said head body has a rounded lower back portion of a certain radius of curvature within a region from said rear end of said sole portion to said rear end of said head body; and wherein said sole portion has a nearly flat surface which is continuously connected at said rear end of said sole portion with said rounded lower back portion.

5. The golf wood clubhead according to claim 4, wherein said leading edge of said head body is formed as a rounded edge.

* * * * *